US006092266A

United States Patent [19]

Lee

[11] Patent Number: 6,092,266

[45] Date of Patent: Jul. 25, 2000

[54] DOUBLE-LAYER WATER-PROOF ZIPPER

[75] Inventor: Leif Lee, Taichung Hsien, Taiwan

[73] Assignee: Xiang Good Inc. Corp. Co., Ltd., Taichung Hsien, Taiwan

[21] Appl. No.: 09/260,557

[22] Filed: Mar. 2, 1999

[51] Int. Cl.[7] ..... A44B 19/32

[52] U.S. Cl. ..... 24/389; 24/384; 24/396

[58] Field of Search ..... 24/389, 384, 396, 24/394, 395, 381

[56] References Cited

U.S. PATENT DOCUMENTS

| | | | |
|---|---|---|---|
| 3,490,109 | 1/1970 | Heimberger | 24/389 |
| 3,668,745 | 6/1972 | Krupp | 24/389 |
| 4,817,252 | 4/1989 | Kusayama | 24/389 |
| 4,987,657 | 1/1991 | Moreland | 24/389 |
| 5,386,616 | 2/1995 | Norvell | 24/384 |

*Primary Examiner*—Victor N. Sakran
*Attorney, Agent, or Firm*—Bacon & Thomas, PLLC

[57] ABSTRACT

A double-layer water-proof zipper in which the slide has an additional second interlocking unit moved with the slide to close a water-proof layer so as not to let rain pass through the interlocked teeth of the zipper tape unit of the zipper. The water-proof layer includes two water-proof tapes, the water-proof tapes each having two longitudinally extended parallel grooves and two longitudinally extended protruding portions respectively raised along said parallel grooves at one side for interlocking.

3 Claims, 8 Drawing Sheets

DOUBLE-LAYER WATER-PROOF ZIPPER

BACKGROUND OF THE INVENTION

The present invention relates to zippers, and more particularly to a double-layer water-proof zipper for use in a travel bag or the like, which does not let water, esp. rain pass through.

A travel bag, as shown in FIG. 1, is made of water-proof material. However, rain water may pass through gaps in the zippers to wet clothes and other storage items in the travel bag. A regular zipper, as shown in FIG. 2, is generally comprised of two rows of interlocking metal or plastic teeth respectively provided at two zipper tapes, and a slide pulled to cloth/open the interlocking teeth. When rain water drops to the zippers at the travel bag, it passes through gaps in between the interlocking teeth to wet the storage items in the travel bag.

SUMMARY OF THE INVENTION

The present invention has been accomplished to provide a zipper which seals out water when closed. According to one aspect of the present invention, the zipper comprises an additional water-proof layer formed of two water-proof tapes that are closed to stop rain from passing through the zipper when the interlocking teeth at two zipper tapes of the zipper are interlocked. According to another aspect of the present invention, the water-proof tapes of the water-proof layer are respectively reinforced with a respective reinforcing flap. In an alternate form of the present invention, the zipper comprises two slides moved to close/open the zipper tapes and the water-proof tapes. The pull tap at one slide can be coupled to a lug at the other slide, so that the slides can be locked by a lock.

DETAILED DESCRIPTION OF THE PREFERRED EMBODIMENT

Figure 1:
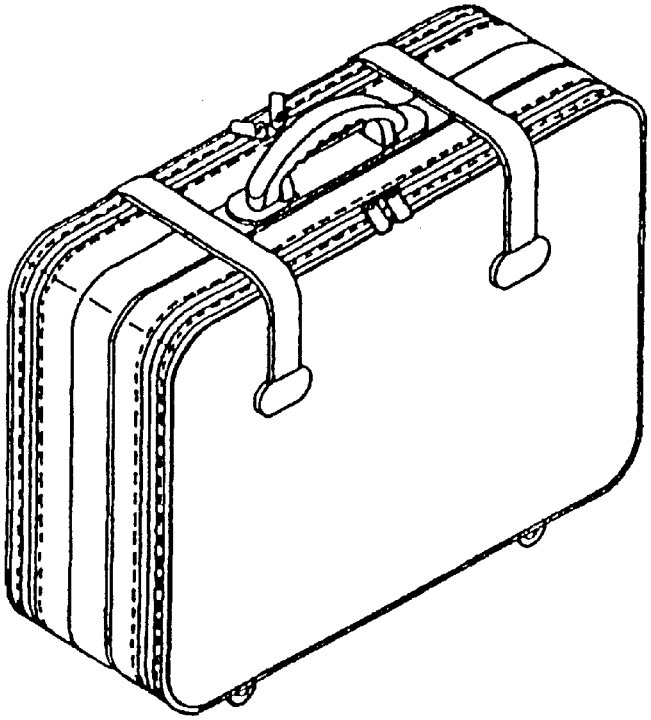
Fig. 1 PRIOR ART
FIG. 1 is a perspective view of a regular travel bag according to the prior art.
Figure 2:
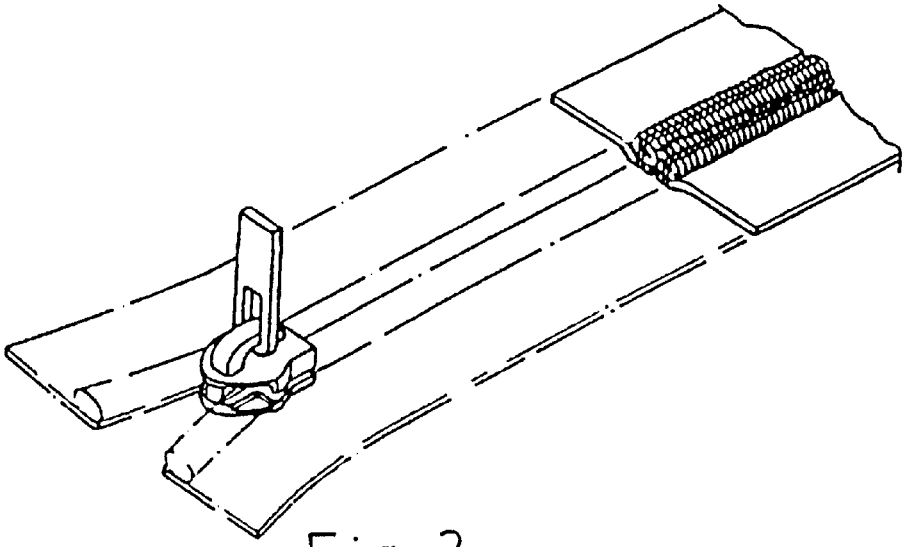
Fig. 2 PRIOR ART
FIG. 2 is a schematic drawings showing the structure of a conventional zipper according to the prior art.
Figure 3:
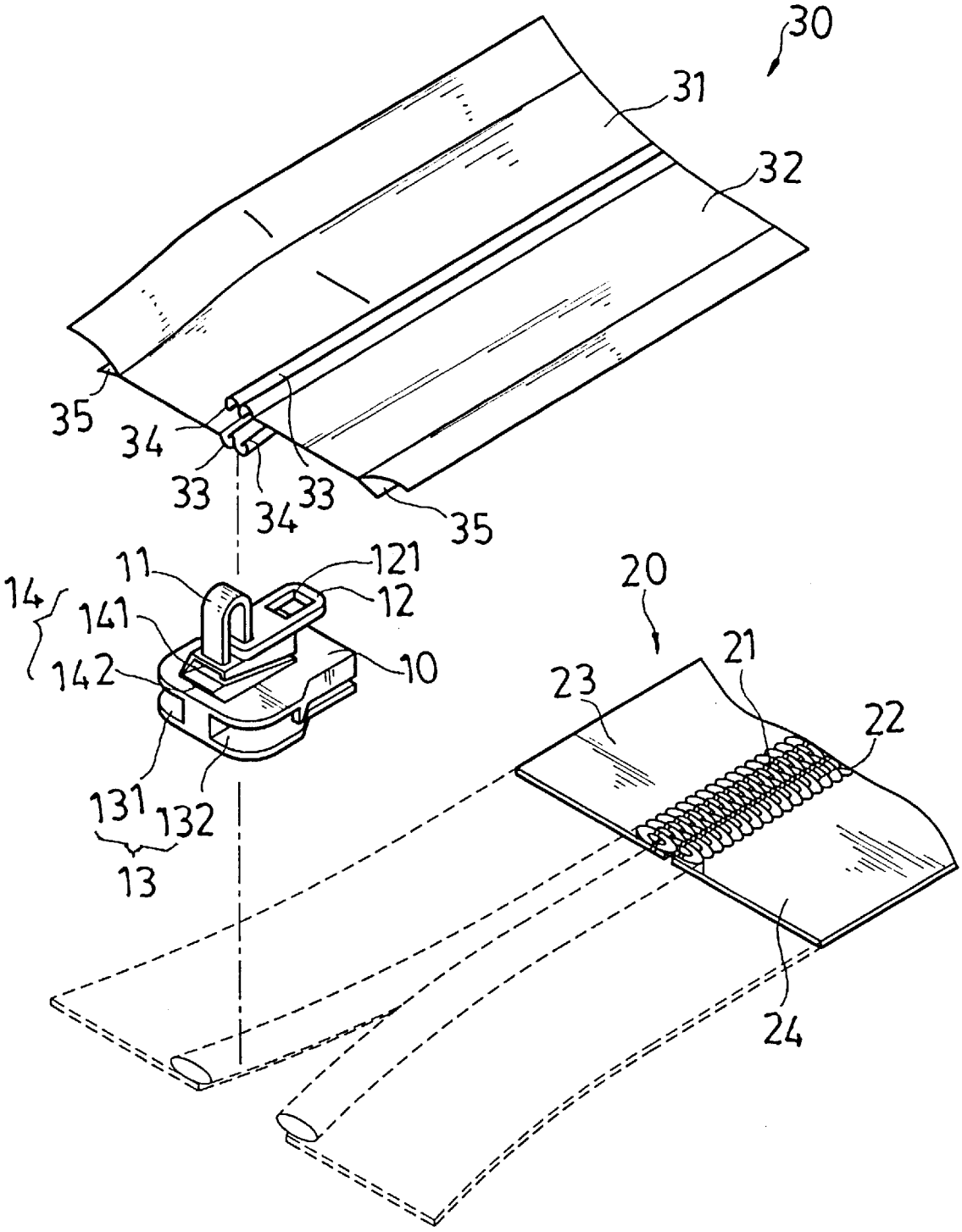
FIG. 3. is an exploded view of a double-layer water-proof zipper according to the present invention.
Figure 4:
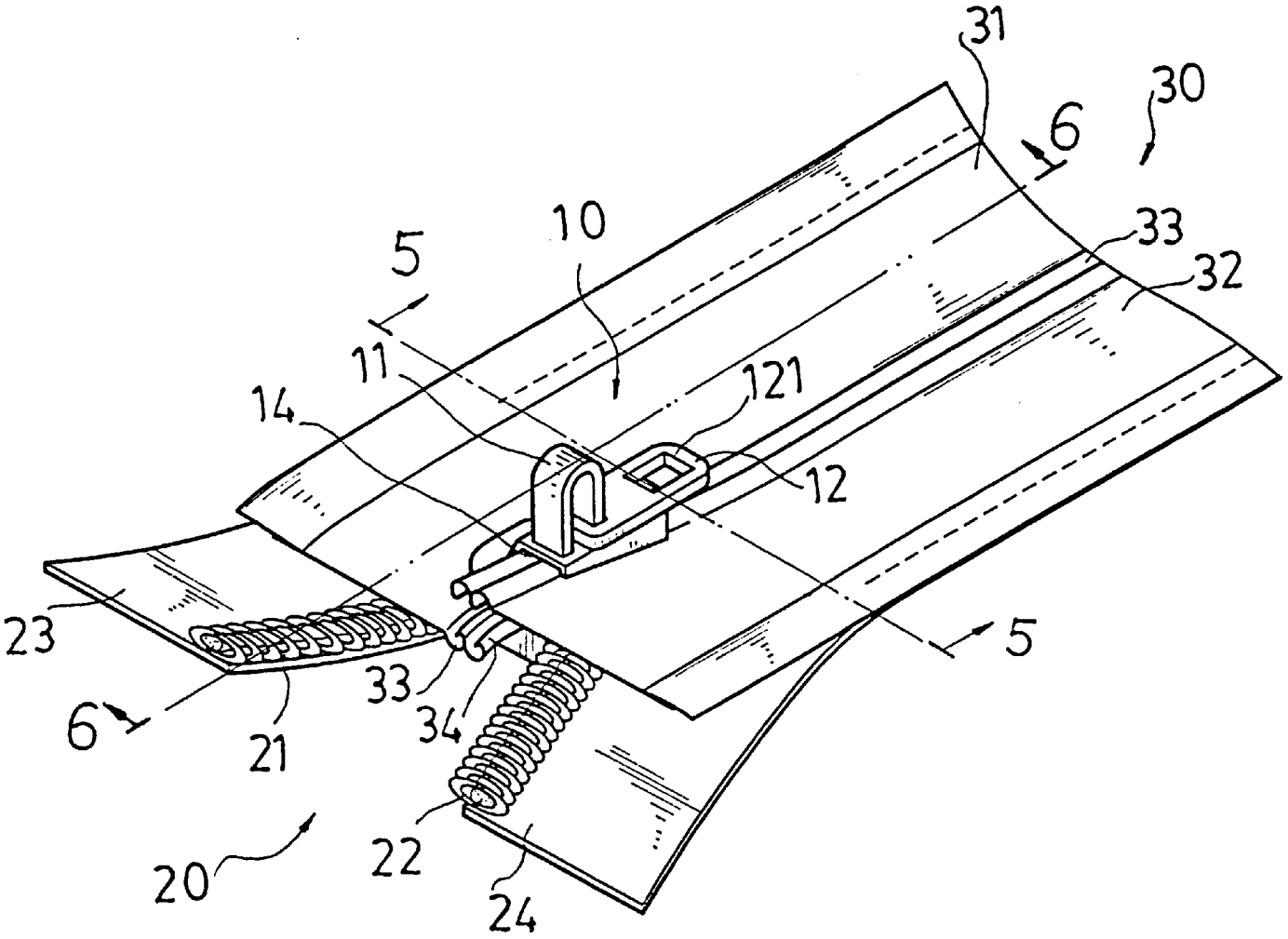
FIG. 4 is a perspective assembly view of the double-layer water-proof zipper according to the present invention.
Figure 5:
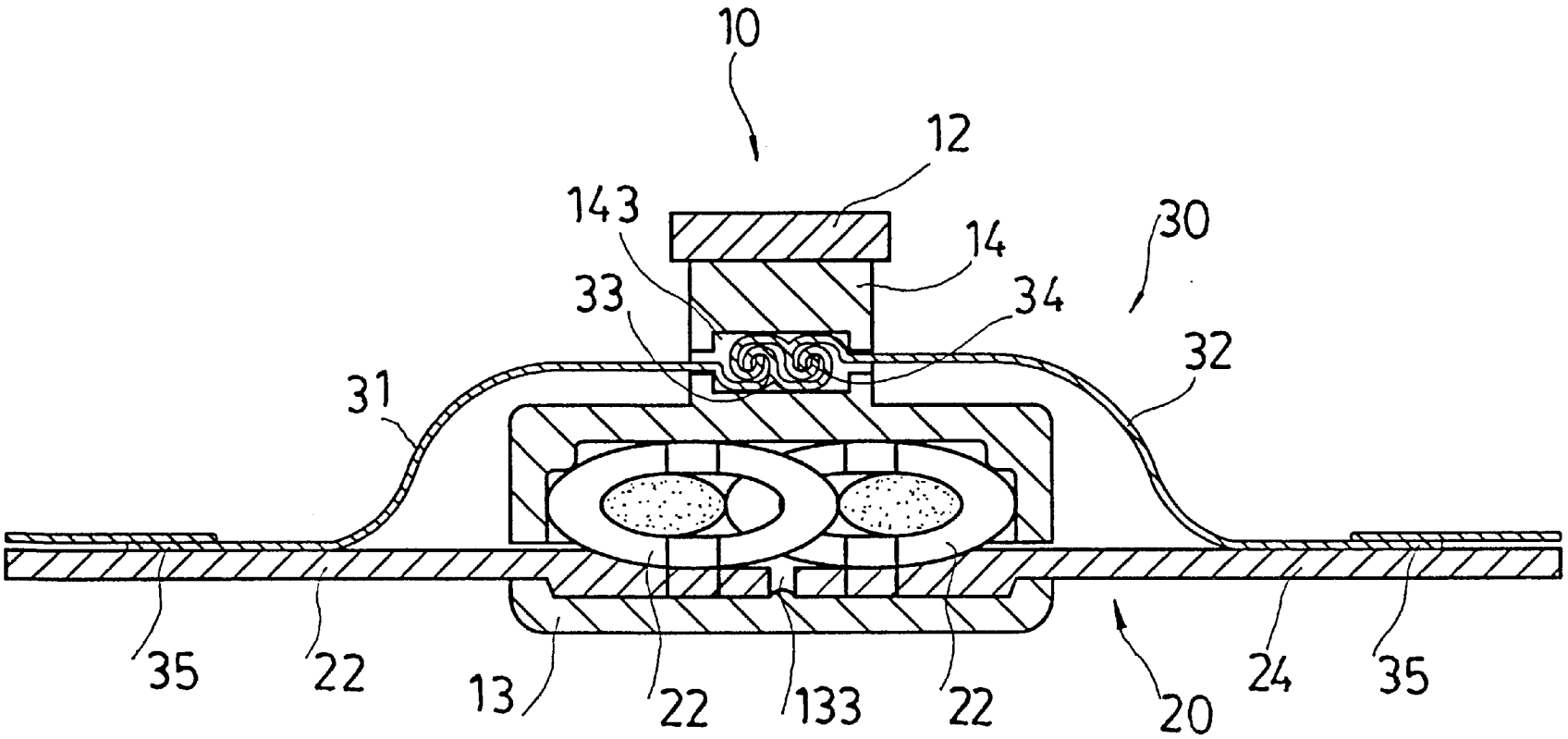
FIG. 5 is a sectional view in an enlarged scale taken along line 5—5 of FIG. 4.
Figure 6:
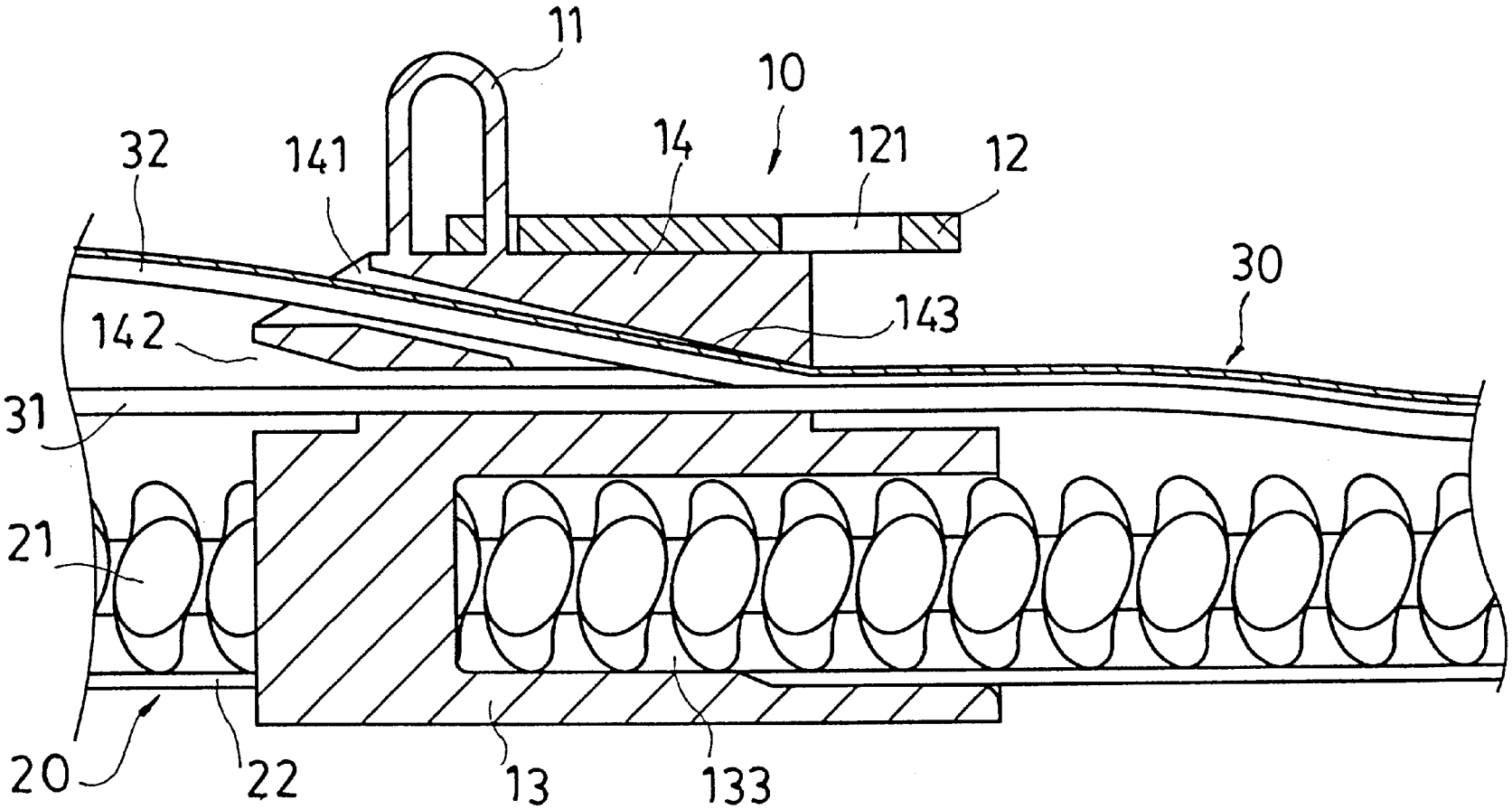
FIG. 6 is a sectional view in an enlarged scale taken along line 6—6 of FIG. 4.

Referring to FIGS. from 3 through 7, a doublelayer water-proof zipper in accordance with one embodiment of the present invention is shown comprised of a slide 10, a zipper tape unit 20, and a water-proof layer 30.

The slide 10 comprises a loop-like lug 11, a pull tab 12 coupled to the lug 11, a first interlocking control unit 13, and a second interlocking control unit 14. The pull tab 12 has a through hole 121 for positive positioning of the fingers. The first interlocking control unit 13 has a substantially I-shaped profile defining a first passage 131, a second passage 132 and a rear interlocking chamber 133. The first passage 131 and the second passage 132 are horizontally arranged in parallel, and axially extended from the front side of the slide 10 to the rear interlocking chamber 133. The transverse width of the passages 131 and 132 gradually reduces toward the rear interlocking chamber 133. The second interlocking control unit 14 is formed integral with the first interlocking control unit 13 at the top, having a substantially S-shaped cross section defining a first passage 141, a second passage 142 and a rear interlocking chamber 143. The first passage 141 and the second passage 142 are disposed at different elevations, and axially forwardly extended from the rear interlocking chamber 143.

The zipper tape unit 20 comprises a first zipper tape 23, a second zipper tape 24, a first row of teeth 21 secured mounted on one side edge of the first zipper tape 23, and a second row of teeth 22 secured mounted on one side edge of the second zipper tape 24 and respectively inserted through the first passage 131 and second passage 132 in the first interlocking control unit 13 of the slide 10.

The water-proof layer 30 is comprised of a first water-proof tape 31, and a second water-proof tape 32. The first water-proof tape 31 and the second water-proof tape 32 are respectively reinforced with a respective reinforcing flap 35, each having one side edge formed with two longitudinally extended parallel grooves 33 and two longitudinally extended protruding portions 34 respectively raised along the parallel grooves 33 at one side. The protruding portions 34 of the water-proof tapes 31 and 32 are respectively inserted through the first passage 141 and second passage 142 in the second interlocking control unit 14 of the slide 14.

Referring to FIGS. from 4 through 6 again, the first row of teeth 21 and the second row of teeth 22 of the zipper tape unit 20 are respectively inserted through the first passage 131 and second passage 132 in the first interlocking control unit 13 of the slide 10, and the protruding portions 34 of the water-proof tapes 31 and 32 of the water-proof layer 30 are respectively inserted through the first passage 141 and second passage 142 in the second interlocking control unit 14 of the slide 14. When the slide 10 is pulled in one direction, the first row of teeth 21 and the second row of teeth 22 of the zipper tape unit 20 are interlocked, and at the same time the protruding portions 34 at one water-proof tape 31 or 32 are engaged into the parallel grooves 34 at the other water-proof tape 32 or 31, causing the overlapped side edges of the water-proof tapes 31 and 32 to be watertightly retained together. On the contrary, when the slide 10 is pulled in the reversed direction, the zipper tape unit 20 as well as the water-proof layer 30 are opened.

Figure 7:
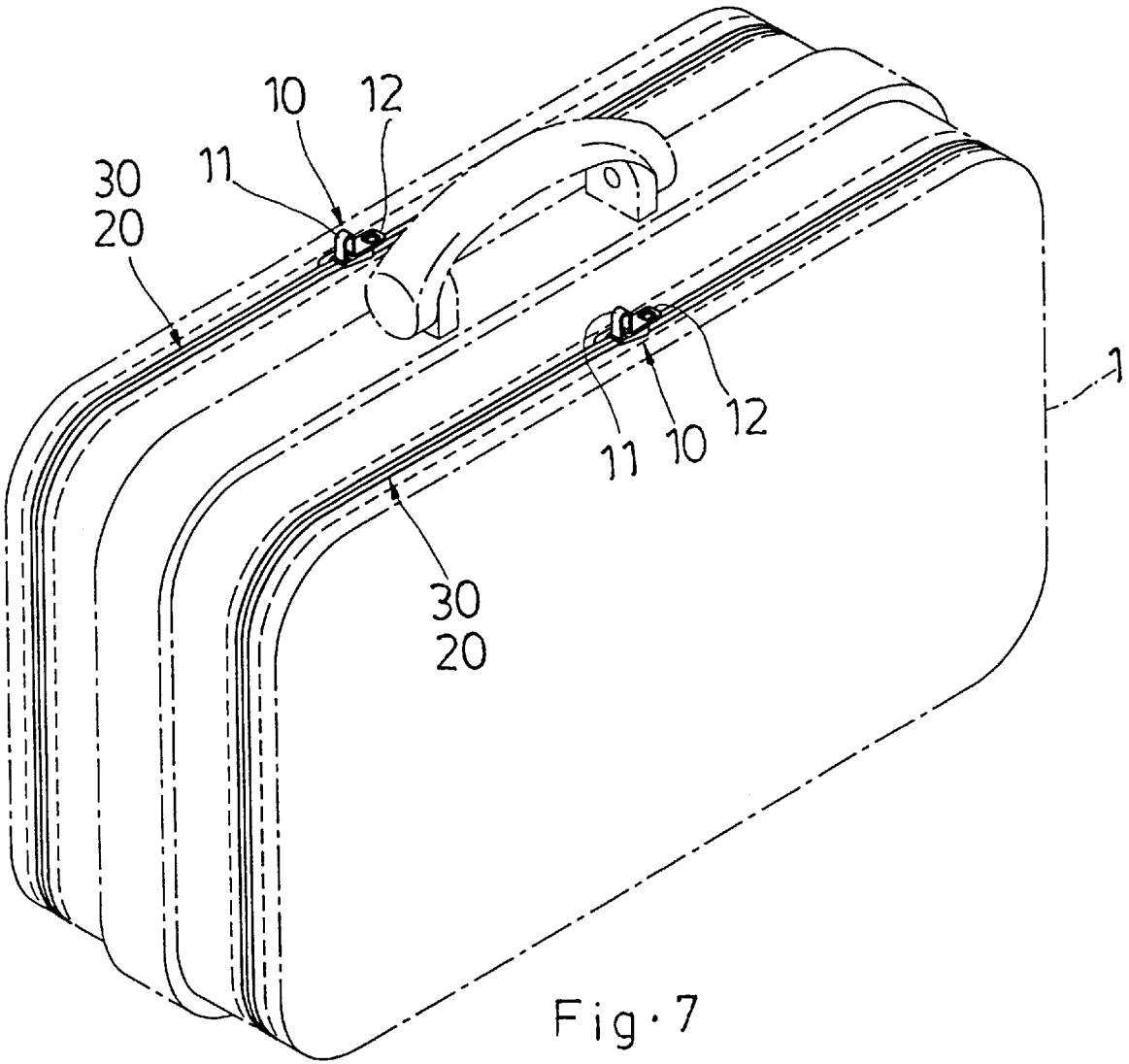
FIG. 7 is an applied view of the present invention, showing the double-layer water-proof zipper used in a travel bag.

FIG. 7 shows the double-layer water-proof zipper used in a travel bag 1. When the double-layer water-proof zipper is closed, the water-proof layer 30 is closed and covered over the zipper tape unit 20 to stop water from passing through the zipper tape unit 20.

Figure 8:
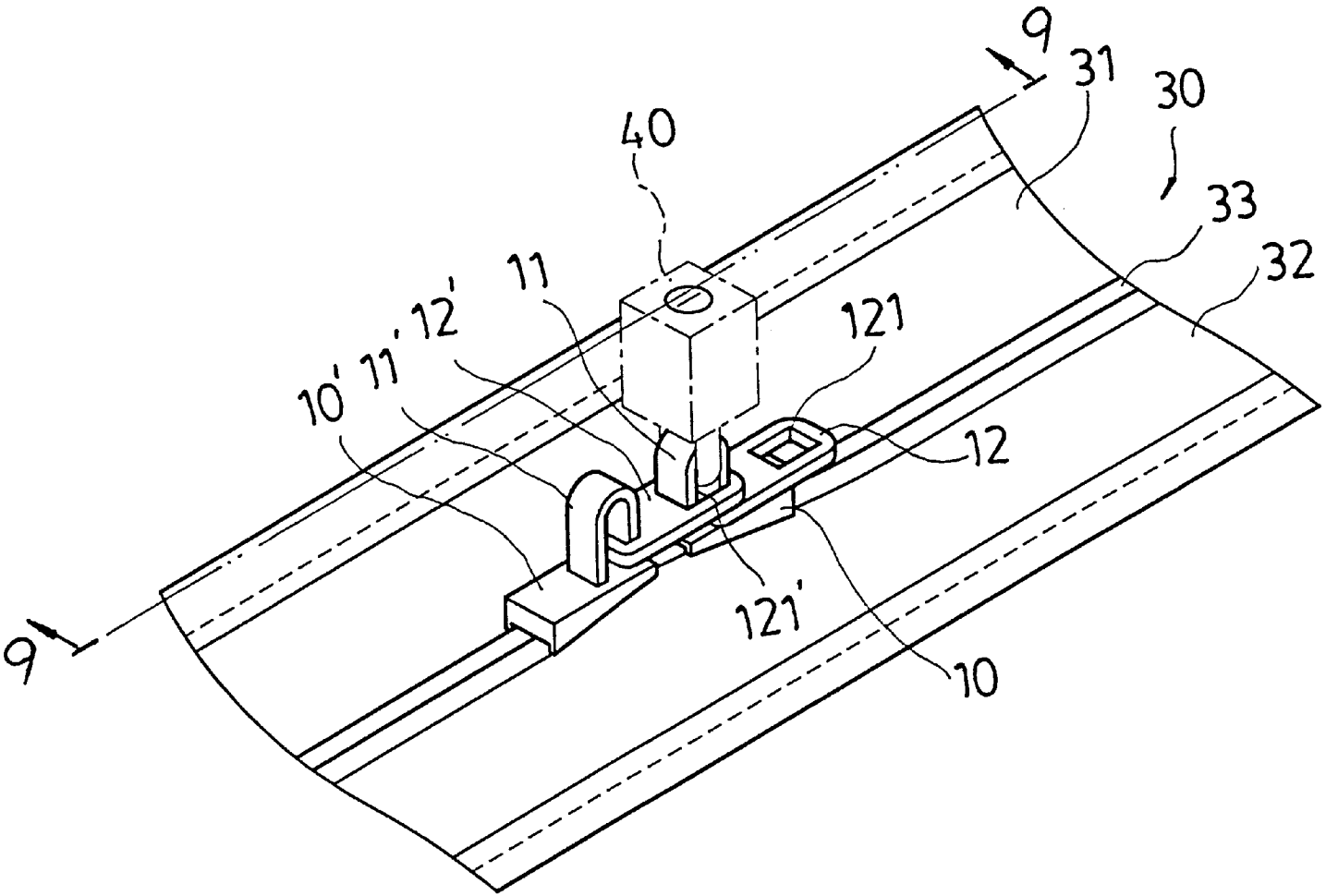
FIG. 8 is a perspective view of an alternate form of the double-layer water-proof zipper according to the present invention.
Figure 9:
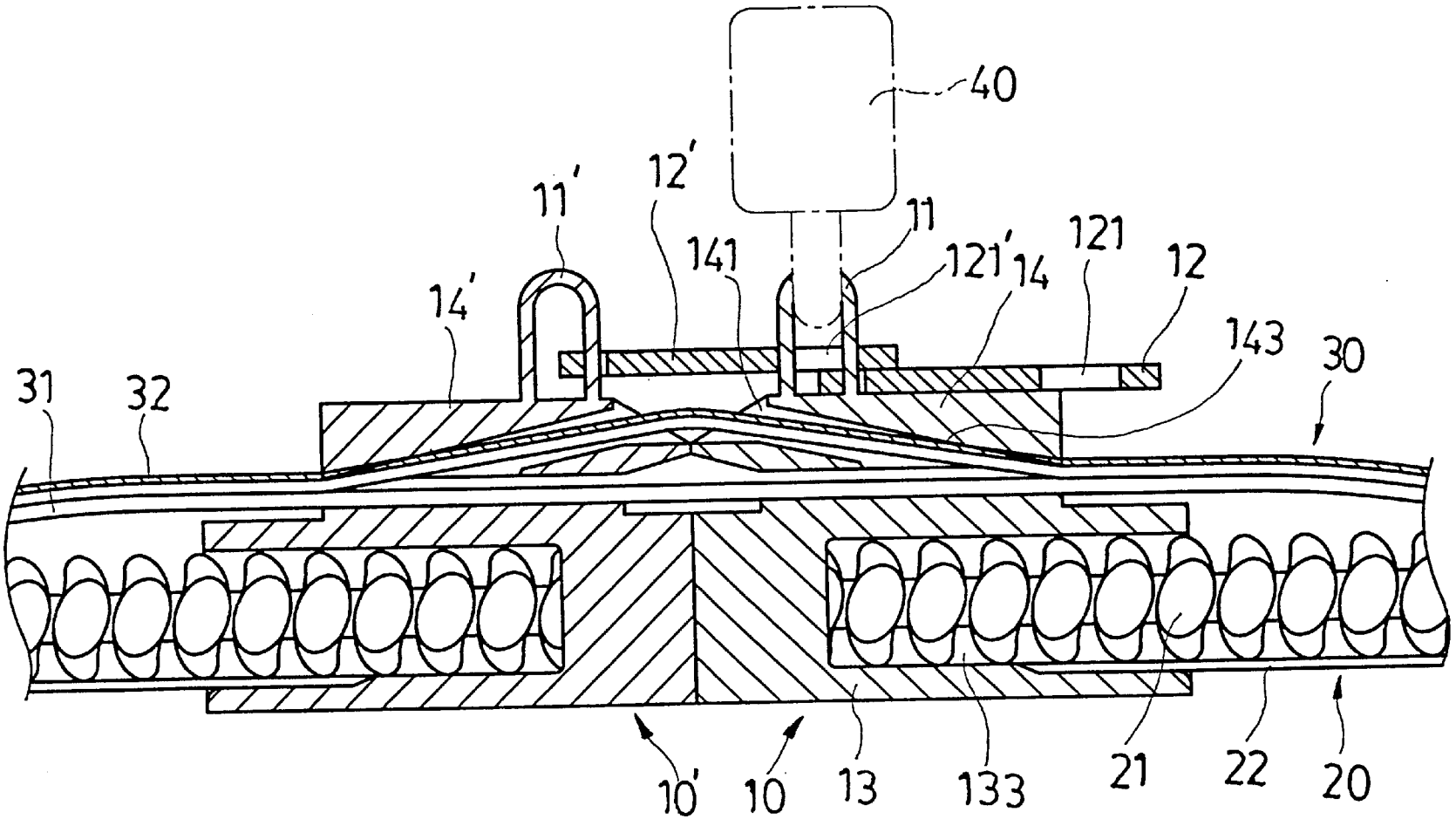
FIG. 9 is a sectional view in an enlarged scale taken along line 9—9 of FIG. 8.

FIGS. 8 and 9 show an alternate form of the present invention. According to this alternate form, a second slide 10' is mounted on the zipper tape unit 20 and the water-proof layer 30. The second slide 10' comprises a loop-like lug 11', a pull tab 12' coupled to the lug 11' and connected to the lug 11 at the first slide 10. The lug 11 of the first slide 10 can be inserted through the through hole 121' at the pull tab 12' of the second slide 10', and then a lock 40 can be installed in the lug 11 of the first slide 10 and lock the first slide 10 and the second slide 10'.

What is claimed is:

1. A double-layer water-proof zipper comprising:

a first slide, said first slide comprising a loop-like lug, a pull tab coupled to the lug at said first slide, a first interlocking control unit, and a second interlocking control unit, said first interlocking control unit having a substantially I-shaped profile defining a first passage, a second passage and a rear interlocking chamber, the first passage and second passage of said first interlocking control unit being horizontally arranged in parallel and axially forwardly extended from the rear interlocking chamber of said first interlocking control unit, the first passage and second passage of said first interlocking control unit having a transverse width gradually reducing toward the rear interlocking chamber of said first interlocking control unit, said second interlocking control unit is formed integral with said first interlocking control unit at a top side, having a S-shaped cross section defining a first passage, a second passage and a rear interlocking chamber, the first passage and second passage being disposed at different elevations and axially forwardly extended from the rear interlocking chamber of said second interlocking control unit;

a zipper tape unit closed/opened by said first slide, said zipper tape unit comprising a first zipper tape, a second zipper tape, a first row of teeth and a second row of teeth respectively securely mounted on said first zipper tape and said second zipper tape and respectively inserted through the first passage and second passage in the first interlocking control unit of said first slide; and a water-proof layer covered over said zipper tape unit to stop water from passing through said zipper tape unit, said water-proof layer comprising a first water-proof tape, and a second water-proof tape overlapped together, said first water-proof tape and said second water-proof tape each having one side edge formed with two longitudinally extended parallel grooves and two longitudinally extended protruding portions respectively raised along said parallel grooves at one side, the protruding portions of said first water-proof tape and said second water-proof tape being respectively inserted through the first passage and second passage in the second interlocking control unit of said slide;

wherein when said first slide is pulled in one direction, the first row of teeth and second row of teeth of said zipper tape unit are interlocked, and at the same time the protruding portions at one water-proof tape of said water-proof layer are engaged into the parallel grooves at the other water-proof tape, causing the overlapped area between the water-proof tapes of said water-proof layer to be water-tightly retained together; when said first slide is pulled in the reversed direction, said zipper tape unit and said water-proof layer are opened.

2. The double-layer water-proof zipper of claim 1 wherein the first water-proof tape and second water-proof tape of said water-proof layer each are reinforced with a respective reinforcing flap.

3. The double-layer water-proof zipper of claim 1 further comprising a second slide moved to close/open said zipper tape unit and said water-proof layer, said second slide comprising a loop-like lug, and a pull tap coupled to the lug at said second slide, the pull tap of said second slide having a through hole for coupling to the lug at said first slide.

* * * * *